US005920305A

United States Patent [19]

Yoon

[11] Patent Number: 5,920,305

[45] Date of Patent: Jul. 6, 1999

[54] MULTICOLOR DISPLAY CONTROL CIRCUIT AND METHOD FOR LIQUID CRYSTAL DISPLAY

[75] Inventor: Hee Gyung Yoon, Seoul, Rep. of Korea

[73] Assignee: LG Electronics Inc., Seoul, Rep. of Korea

[21] Appl. No.: 08/998,026

[22] Filed: Dec. 24, 1997

[30] Foreign Application Priority Data

Dec. 27, 1996 [KR] Rep. of Korea ..... 96-73923

[51] Int. Cl.[6] ..... G09G 5/04

[52] U.S. Cl. ..... 345/153; 345/149; 345/155

[58] Field of Search ..... 345/436, 137, 345/138, 147, 149, 150, 153, 155

[56] References Cited

U.S. PATENT DOCUMENTS

| | | | |
|---|---|---|---|
| 5,138,303 | 8/1992 | Rupel | 345/155 |
| 5,734,369 | 3/1998 | Priem et al. | 345/153 |
| 5,748,163 | 5/1998 | Han | 345/149 |

*Primary Examiner*—Matthew Luu

*Attorney, Agent, or Firm*—Morgan, Lewis, & Bockius LLP

[57] ABSTRACT

A dither circuit and method for reproducing a multicolor image includes a latch having input terminals for 8 input data bits and clock signal, and output terminals for six high bits and two low bits of the input-data bits; a dither timing generator having input terminals for a horizontal sync signal, a vertical sync signal and a clock signal and output terminals for a first dither timing bit and the second dither timing bit, wherein the first dither timing bit is toggled according to each cycle of the horizontal sync signal and the second dither timing bit is toggled according to each cycle of the vertical sync signal; a dither data controlierhaving input terminals for the two low bits, the first and the second dither timing bits and an output terminal for applying four dither data bits generated using the two low bits and the first and the second dither timing bits sequentially; and an adder having an input terminal for the dither data bit and six high bits, and output terminals for six output data bits.

25 Claims, 8 Drawing Sheets

| | | | | |
|---|---|---|---|---|
| A | B | A | B | |
| C | D | C | C | |
| A | B | A | B | |
| C | D | C | C | |
| | | | | |

| | | | | | | | |
|---|---|---|---|---|---|---|---|
| 45 | 45 | 45 | 46 | 45 | 46 | 45 | 46 |
| 45 | 45 | 45 | 45 | 46 | 45 | 46 | 46 |
| 45 | 45 | 45 | 45 | 45 | 46 | 46 | 46 |
| 45 | 45 | 46 | 45 | 46 | 45 | 46 | 45 |
| 45 | 45 | 45 | 45 | 46 | 45 | 46 | 46 |
| 45 | 45 | 45 | 46 | 45 | 46 | 45 | 46 |
| 45 | 45 | 46 | 45 | 46 | 45 | 46 | 45 |
| 45 | 45 | 45 | 45 | 45 | 46 | 46 | 46 |

FIG. 11

| | | | | | | | |
|---|---|---|---|---|---|---|---|
| 45 | 45 | 45 | 46 | 45 | 46 | 45 | 46 |
| 45 | 45 | 45 | 45 | 46 | 45 | 46 | 46 |
| 45 | 45 | 45 | 45 | 45 | 46 | 46 | 46 |
| 45 | 45 | 46 | 45 | 46 | 45 | 46 | 45 |
| 45 | 45 | 45 | 45 | 46 | 45 | 46 | 46 |
| 45 | 45 | 45 | 46 | 45 | 46 | 45 | 46 |
| 45 | 45 | 46 | 45 | 46 | 45 | 46 | 45 |
| 45 | 45 | 45 | 45 | 45 | 46 | 46 | 46 |

FIG. 12a

| | | | | | | | |
|---|---|---|---|---|---|---|---|
| | 45 | 45 | 45 | 46 | 45 | 46 | 45 |
| | 45 | 45 | 45 | 45 | 46 | 45 | 46 |
| | 45 | 45 | 45 | 45 | 45 | 46 | 46 |
| | 45 | 45 | 46 | 45 | 46 | 45 | 46 |
| | 45 | 45 | 45 | 45 | 46 | 45 | 46 |
| | 45 | 45 | 45 | 46 | 45 | 46 | 45 |
| | 45 | 45 | 46 | 45 | 46 | 45 | 46 |

FIG. 12b

MULTICOLOR DISPLAY CONTROL CIRCUIT AND METHOD FOR LIQUID CRYSTAL DISPLAY

This application claims the benefit of Application No. 96-73923, filed in Korea on Dec. 27, 1996, which is hereby incorporated by reference.

BACKGROUND OF THE INVENTION

FIELD OF THE INVENTION

The present invention relates to a dither circuit and method wherein color display information is converted into pixel information for a flat panel display, and more particularly, to a dither circuit and method which presents more colors using fewer color levels.

DESCRIPTION OF THE BACKGROUND ART

The CRT (Cathode Ray Tube), which is presently the most common display device, produces a color display using electron guns for a red color, a green color and a blue color. The thickness of the CRT must increase as the screen size becomes larger. Moreover, a CRT device requires there be a sufficient distance between the electron guns and the screen of the CRT to produce an image. Accordingly, the CRT device, such as a TV, must be replaced with a different device, such as a beam projector in large environments.

In recent years, many flat display devices have been developed as alternatives to the CRT. Among them, a liquid crystal display (LCD) device has become popular. Conventionally, the LCD comprises, as shown in FIG. 1 a controller IC 10, a scan line driver IC 12, a signal line driver 11, and an array of thin film transistors (TFT array) 13. A plurality of scan lines 16 are connected to the out line of the scan line driver IC 12, and a plurlity of signal lines 15 are connected to the out line of the signal line driver IC 13. At the intersection area of the scan lines 16 and the signal lines 15, thin film transistors 13 connecting with pixels 14 are arrayed. A gate electrode of the thin film transistor 13 is connected to the scan line 16 and a source electrode is connected to the signal line 15 and a drain electrode is connected to the pixel electrode 14. When certain voltage is applied to the gate electrode of the TFT 13, then the source electrode of the TFT 13 and the drain electrode are electrically connected. If there is no voltage at the gate electrode, the source and the drain electrodes are electrically isolated.

The conventional method for reproducing the image information in the LCD device will now be described. The image information is converted into a signal voltage at the controller IC 10 and the signal voltage is held at the signal line driver IC 11. The signal line driver IC 11 outputs the signal voltage to the signal line 15 according to the scan signal.

For example, when the scan line driver IC 12 outputs the scan voltage at the first scan line 16 according to the predetermined frequency signal, the TFTs 13 connected to the first scan line 16 are turned on and the signal voltages of the first line of the image information are supplied to the first line of the pixel 14 electrode array. Then, when the scan line driver IC 12 outputs the scan voltage at the second scan line 16, the signal line driver IC 11 outputs the second line of the image information to the second line of the pixei 14 electrode array. With the same method as mentioned above, the other lines of the image information are applied to the other lines of the pixel 14 electrode array. Thus, the image information is reproduced at the screen of the LCD.

In order to reproduce the image information having colors, the image information is divided into color information comprising red, green and blue color. These color elements (R,G and B) are joined into one pixel of the LCD screen. These techniques are well known in the art and enable efficient manufacturing of color LCD devices. The conventional method for reproducing color information in an LCD device will now be described.

FIG. 2 shows the structure of the conventional controller IC in color LCD devices. The conventional controller IC 10 comprises a ROM (Read Only Memory) table 21 having color data bits which are sent to the signal lines 15 according to the horizontal sync signal ($H_s$) and the vertical sync signal ($V_s$), a latch 22 receives input image data according to the clock signal (CK) and sends an address signal to the ROM table 21, and a FRC (Frame Rate Controller) 20 sends a signal for determining the dot position and the frame page of the color data from the ROM.

The input color data comprising L bits from the video processing unit, such as a VGA card, are sent to the latch 22 according to the clock signal. At the latch 22, the input color data are translated into address bits representing the address of the color data in the ROM 21. Then, the FRC 20 determines the scan line 16 in which the dot belongs according to the horizontal sync signal and the frame page of the color data according to the vertical sync signal. That is, the input color data is used for the address data of the ROM 21 having the output color data. The output color data from the ROM 21 is applied to the signal line driver IC 11. The output color data determines the voltage level for driving the liquid crystal. The color image is reproduced at the LCD screen according to the driving voltage level of the liquid crystal.

Here, the number of colors is determined by the bit number of output color data. If the bit number, L, is 3, then the color dots, R, G and B, have 3 bit color level. So, the color number of one pixel is $2^9$. That is, the 512 colors can be reproduced at the same time. The meaning of the "true color" is that the color dots, R, G and B, have 8 bit color level, so the number of color in one pixel is $2^{24}$(=16,777,216). Hence, a display with "true color" can reproduce 16.7 Mega colors at the same time.

In the controller IC, the number of bits of the input color data is 8 bits, so the input color data is true color. However, the output color data is not 8 bits. Because the driver IC for 8 bits is very expensive, the total price of LCD becomes expensive. At present, the price of the driver IC for 3 to 6 bits is between US$5 and US$9, and that of the 8 bits is from US$25 to US$40.

Furthermore, if the output data bus line is 8 bits, then the method for manufacturing the LCD panel is more complicated than using less bit data bus line than 8 bits. Accordingly, there has been much research and development to produce true color using less bits than 8 bits.

In the conventional controller IC, the ROM table is used to reproduce the color information, but the ROM is also very expensive. Even though the output color data is to be 6 bits, the frames for reproducing the true color must have different color levels. Thus, the ROM is necessary, thereby preventing reduction in the price of manufacturing the LCD.

SUMMARY OF THE INVENTION

Accordingly, the present invention is directed to a multicolor display control circuit and method for a liquid crystal display that substantially obviates one or more of the problems due to limitations and disadvantages of the related art.

The object of the present invention is to provide an LCD driving circuit and method for producing true color using fewer bits than input color data bits, 8 bits, and not using the ROM for memory color table.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dither circuit for reproducing a multicolor image comprises a latch having input terminals for 8 input data bits and clock signal, and output terminals for six high bits and two low bits of the input data bits; a dither timing generator having input terminals for a horizontal sync signal, a vertical sync signal and a clock signal and output terminals for a first dither timing bit and the second dither timing bit, wherein the first dither timing bit is toggled according to each cycle of the horizontal sync signal and the second dither timing bit is toggled according to each cycle of the vertical sync signal; a dither data controller having input terminals for the two low bits, the first and the second dither timing bits and an output terminal for applying four dither data bits generated using the two low bits and the first and the second dither timing bits sequentially; and an adder having an input terminal for the dither data bit and six high bits, and output terminals for six output data bits.

In another aspect, the dither circuit for reproducing a multicolor image comprises a latch having input terminals for L input data bits and clock signal, and output terminals for high L-2 bits and two low bits of the input data bits; a dither timing generator having input terminals for a horizontal sync signal, a vertical sync signal and a clock signal and output terminals for a first dither timing bit and the second dither timing bit, wherein the first dither timing bit is toggled according to each cycle of the horizontal sync signal and the second dither timing bit is toggled according to each cycle of the vertical sync signal; a dither data controller having input terminals for the two low bits, the first and the second dither timing bits, and an output terminal for applying four dither data bits generated using the low 2 bits and the first and the second dither timing bits sequentially; and an adder having an input terminal for the dither data bit and L-2 high bits, and output terminals for L-2 output data bits.

In another aspect, the method for reproducing a dithered multicolor image comprises the steps of dividing pixels of a screen into 2×2 matrixes wherein elements of the matrixes are four pixels; applying multicolor data having L bit levels to the four pixels; applying a multicolor data having the L bit levels to one of the four pixels and a multicolor having the one level higher bit than the L bit to the other three pixels; applying a multicolor having the L bit level to two of the four pixels and a multicolor having the one level higher bit than the L bit to the other two pixels; and applying a multicolor having the L bit level to three of the four pixels and a multicolor having the one level higher bit than the L bit to the remaining one of the four pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 11 is a diagram of a portion of the LCD panel having the dither pattern of the present invention; and FIGS. 12*a* and 12*b* are diagrams of portions of the LCD panel having the dither pattern of the first and second embodiments of the present invention.

DETAILED DESCRIPTION OF THE PREFERRED EMBODIMENTS

Figure 1:
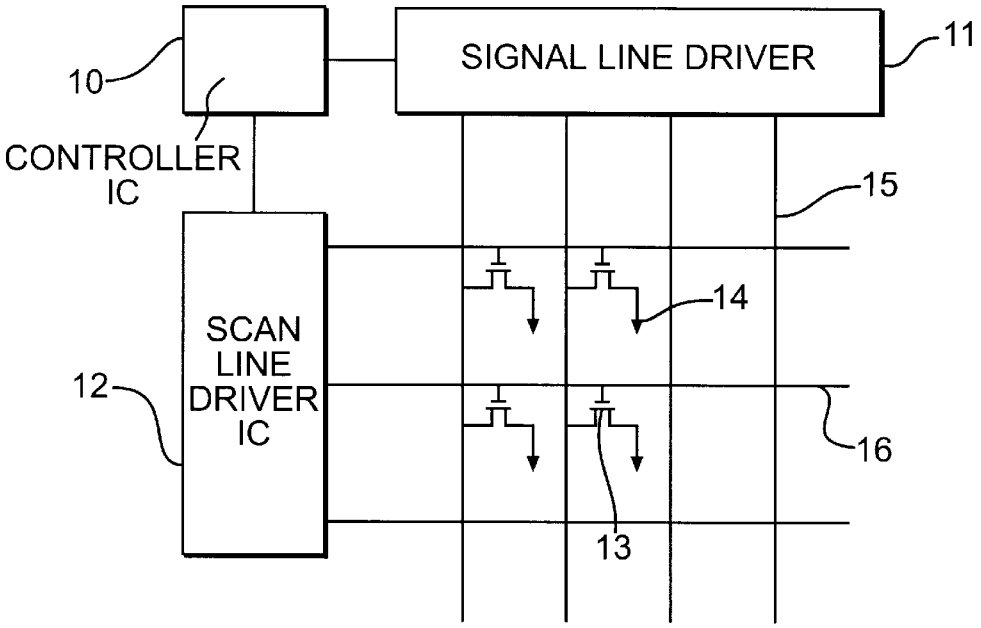
FIG. 1 CONVENTIONAL ART
FIG. 1 is a schematic diagram of a thin film transistor array and the driving IC in a conventional LCD.
Figure 2:
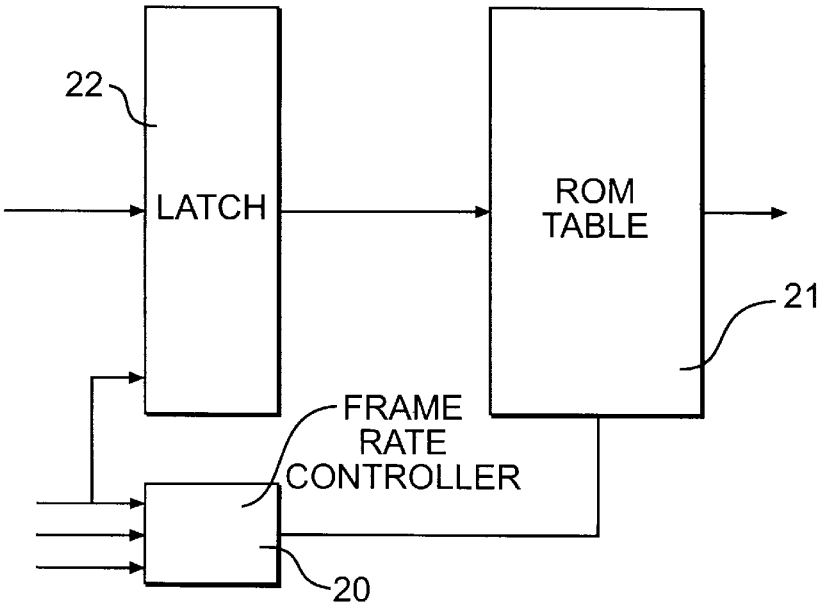
FIG. 2 CONVENTIONAL ART
FIG. 2 is a diagram of a portion of the structure of the conventional dithering controller IC of the conventional color LCD.

Reference will now be made in detail to the preferred embodiments of the present invention, examples of which are illustrated in the accompanying drawings.

According to the present invention, the input color information comprising 8 bits is reproduced as "pseudo color" information comprising 6 bits by joining the near 4 pixels into one pixel. The pixel has a main color comprising 6 bit level and the 4 element pixels have dithered color value comprising 2 bits. Thus, joining the 4 pixels into one pixel presents as the near value of the input color information.

Figures 3, 4:
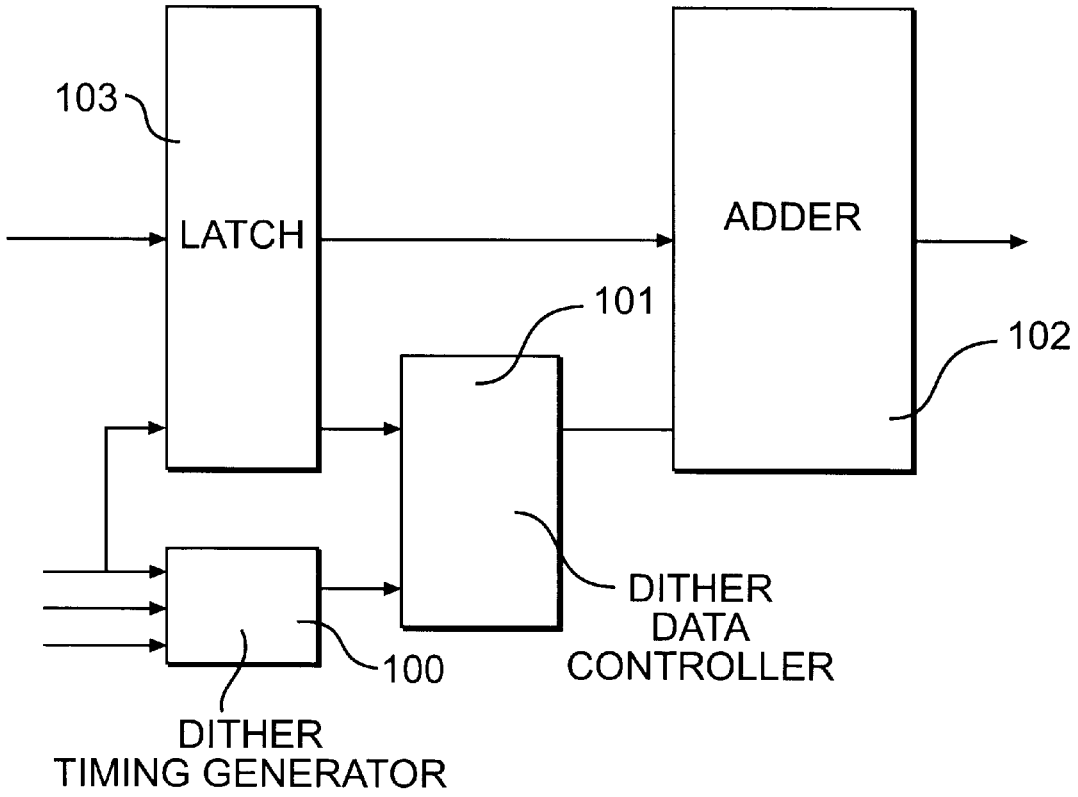
FIG. 3 is a diagram showing the structure of the dithering controller for the LCD of the present invention.
FIG. 4 is a diagram showing pixel groups having 4 pixels in the LCD panel.

In the present invention, the dither control circuit comprises, as shown FIG. 3, a latch 103 having input terminals and dividing the input color information having L bits into M high bits and (L-M) low bits; a dither timing generator 100 outputting dither timing bits having (L-M) bits by inputting a horizontal sync signal ($H_s$) and a vertical sync signal ($V_s$) and a clock signal (CK); a dither data controller 101 outputting a dither data (DD) bit by a dither processing with the (L-M) low bits and the dither timing bits; and an adder 102 generating output color information having M bits by adding the M high bits and the dither data (DD) bit.

In the dither processing of the present invention, the input color information of one pixel having L bits is input to the latch 103. The L bits divided into M high bits and (L-M) low bits. In the dither timing generator 100, the dither timing bits are generated using the horizontal sync signal, the vertical sync signal, and the clock signal. When the position of the color information is determined by the horizontal and the vertical sync signal, the dither data controller 101 generates a dither data bit using the dither timing bits and the (L-M) low bits. The dither data bit is added to the M high bits, and the complemented output color information is generated. Hence, the present invention reproduces the color information by converting the original color information having L bits to the pseudo color information having M bits, the M bits being less than L bits. Embodiments of the present invention will now be discussed in more detail.

First Embodiment

Figure 5:
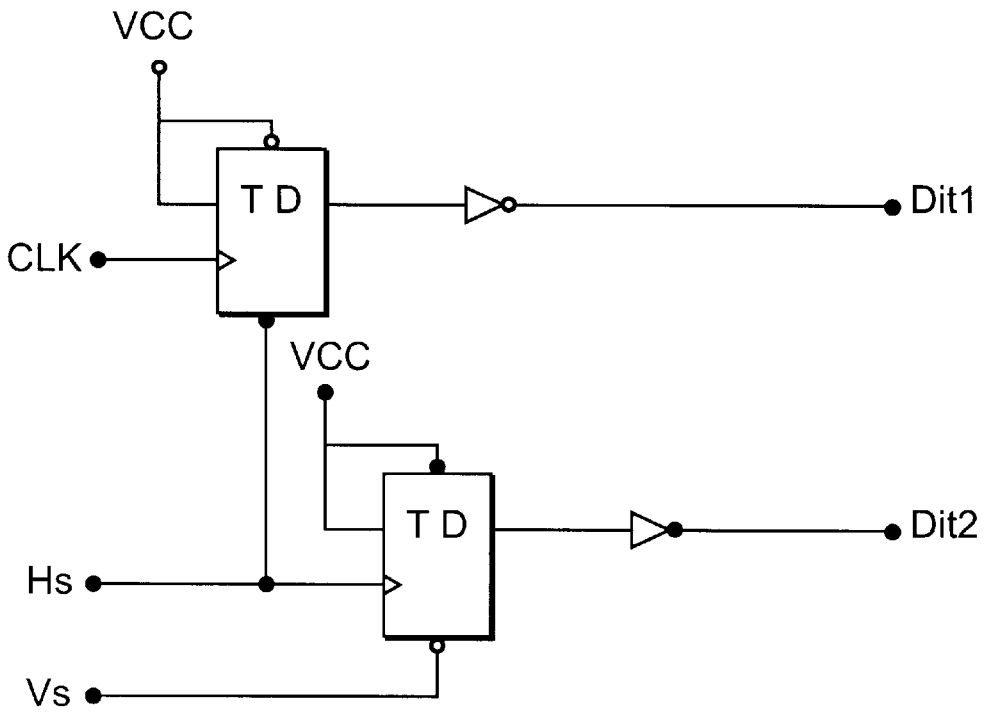
FIG. 5 is a diagram of an exemplary dither timing generator in the present invention.
Figure 6:
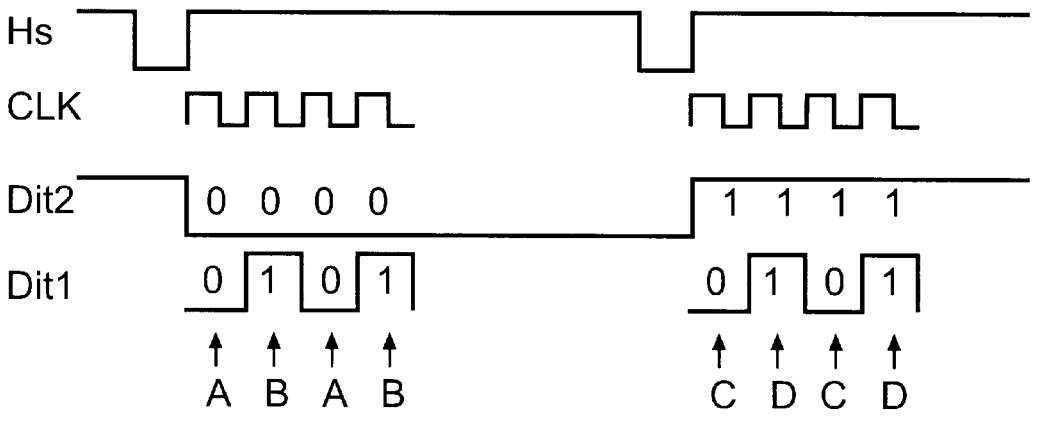
FIG. 6 is a timing diagram of signal shapes of the Dit1 and Dit2 in the present invention.

The pixels on the LCD screen are divided into 2×2 matrixes, and the matrix elements are divided into 4 dither groups, A, B, C and D, as shown FIG. 4. At the dither timing generator 100, dither timing matrix signals, Dit1 and Dit2, representing the position of the color data in the dither group are generated using the horizontal sync signal ($H_s$) and the clock signal (CK). For example, the circuit as shown in FIG. 5 can generate the Dit1 and Dit2 signals. So, the shapes of the Dit1 and Dit2 signals are as shown FIG. 6. The Dit1 signal has a reversed phase according to each cycle of the clock signal, and the Dit2 signal has a signal phase reversed at each cycle of the horizontal sync signal ($H_s$). That is, the Dit1 has twice the cycle of the clock cycle, and the Dit2 has twice the cycle of the horizontal sync cycle. If the shape of the high signal is 1 and that of low signal is 0, then the dithered groups are selected according to the combination of the Dit1 and the Dit2 signal, as shown Table 1.

TABLE 1

The position of the dithered data

| | Dit1 | Dit2 |
|---|---|---|
| A group | 0 | 0 |
| B group | 0 | 1 |
| C group | 1 | 0 |
| D group | 1 | 1 |

When the phases of the Dit1 and the Dit2 are all lows (0s), the A group pixels are selected. When the Dit1 is low and the Dit2 is high, the B group is selected. When the Dit1 is high and Dit2 is low, the C group is selected. In the remaining case, the group is selected.

Figure 7:
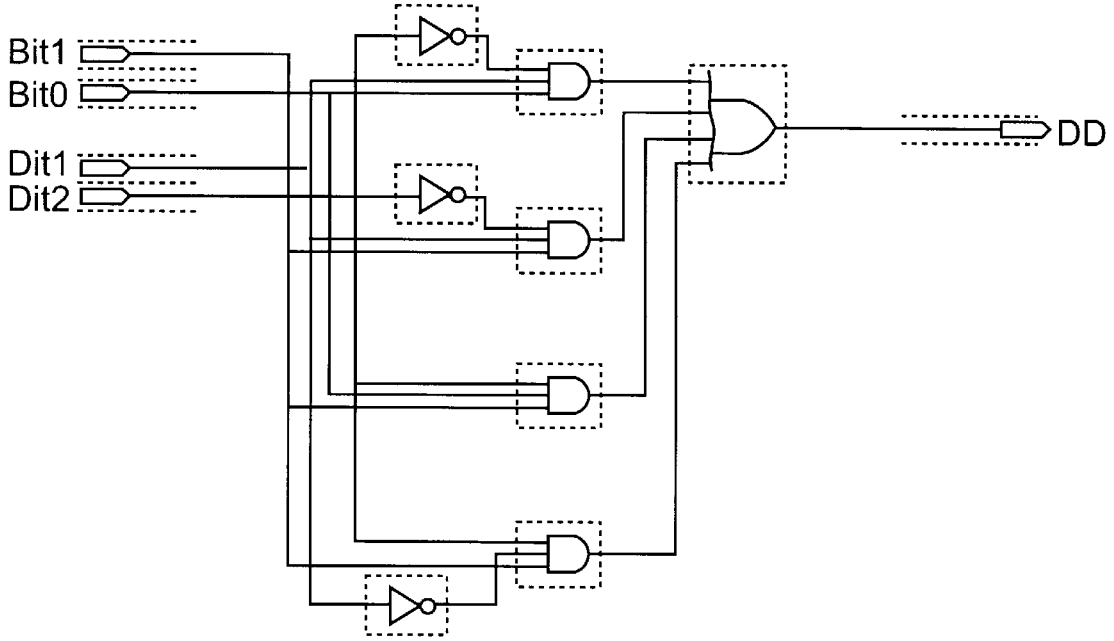
FIG. 7 is a schematic diagram of a logic circuit generating the dither data DD in the present invention.

The input color information comprising 8 bits is divided high 6 bits (bit2, bit3, bit4, bit5, bit6 and bit7) and low 2 bits (bit0 and bit1) in the latch. The low 2 bits, bit0 and bit1 and the dither timing matrix signals, Dit1 and Dit2, are received into the dither data controller. The dither data controller generates a dither data (called DD) bit, 1 or 0. The dither data controller, for example, can be comprised of logic circuits as shown in FIG. 7. and the logic equation is:

$$DD=Dit2'*Dit1*bit0+Dit2'*Dit1*bit1+Dit2*bit1*bit0+dit2*Dit1'*bit1$$

That is, when the position of one element is selected using the horizontal sync signal and the clock signal, the dithered data for the element of a pixel is generated in the dither data controller using low 2 bits of the color information and the dither timing matrix bits. The dithered data is added with the high 6 bits in the adder. Output color data having 6 bits are generated and sent to the signal driving IC.

Each element reproduces the 6 bit color level. Thus, the color level comprises 64 scale colors. On the other hand, the input color information having 8 bits comprises 256 scale colors. Therefore, the $128^{th}$ scale in the 8 bit scale can be reproduced the $32^{nd}$ scale in the 6 bit scale. However, the $33^{rd}$ scale in the 6 bit scale is equivalent to the $132^{nd}$ scale in the 8 bit scale. The one difference of the scale in the 6 bit scale is a 4 fold difference ot the scale in the 8 bit scale, so there are 3 additional values in the 8 bit scale. In order to reproduce the 3 additional values, 4 elements are combined and represent one color. So, the present invention reproduces true color using a 6 bit scale. Table 2 shows the relationship of the dither pattern and the dithered data.

TABLE 2

Relation between the dither pattern and dither data

| | 1/4 Dither | 2/4 Dither | 3/4 Dither |
|---|---|---|---|
| A group | 0 | 0 | 0 |
| B group | 1 | 1 | 1 |
| C group | 0 | 1 | 1 |
| D group | 0 | 0 | 1 |

As shown in Table 2, the 0 indicates that the element reproduces the color scale with the high 6 bit of the 8 bit of the input color bits. The 1 indicates that the element reproduces the color scale with the one level higher scale color from the high 6 bit of the 8 bits. In the case of ¼ dither, one element among A, B, C and D has the one level higher color scale and the others have the original color scale. In the case of ⅔ dither, the two elements among A, B, C and D have the one higher level scale, the others have the original color scale. In the case of ¾ dither, the three elements have the one level higher scale and the other has the original scale.

The relationship of the low bits, the dither timing matrix bits and the dithered data is represented in Table 3.

TABLE 3

The true-false table of the dithered data bit

| Dit2 | Dit1 | bit1 | bit0 | DD | Group |
|---|---|---|---|---|---|
| 0 | 0 | 0 | 0 | 0 | A |
| 0 | 0 | 0 | 1 | 0 | A |
| 0 | 0 | 1 | 0 | 0 | A |
| 0 | 0 | 1 | 1 | 0 | A |
| 0 | 1 | 0 | 0 | 0 | B |
| 0 | 1 | 0 | 1 | 1 | B |
| 0 | 1 | 1 | 0 | 1 | B |
| 0 | 1 | 1 | 1 | 1 | B |
| 1 | 0 | 0 | 0 | 0 | C |
| 1 | 0 | 0 | 1 | 0 | C |
| 1 | 0 | 1 | 0 | 1 | C |
| 1 | 0 | 1 | 1 | 1 | C |
| 1 | 1 | 0 | 0 | 0 | D |
| 1 | 1 | 0 | 1 | 0 | D |
| 1 | 1 | 1 | 0 | 0 | D |
| 1 | 1 | 1 | 1 | 1 | D |

Figure 8A:
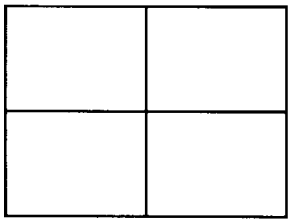
FIGS. 8*a* through 8*d* are dithered color patterns of a pixel and its 4 elements having 6 bits color data according to a first embodiment of the present invention.

The embodiment of Table 3 will be explained in detail when, for example, the input color data of one pixel is represented as 10110100 in binary. This data comprises 8 bits and the low 2 bits, bit0 and bit1, are 0s. In this case, when the Dit1 and Dit2 are 0s, then DD is 0 and A group is selected. This means that the dithered data is 0 bit, so the high 0 bits. 101101, are applied to the A group. When Dit1 is 1 and Dit2 is 0, DD is 0, and the B group is selected. Thus, the high 6 bits, 101101, are applied to the B group. When Dit1 is 0 and Dit2 is 1, DD is 0 and the C group is selected. Thus, the high 6 bits, 101101, are applied to the C group. When the Dit1 and Dit2 are 1s, DD is 0 and the D group is selected. As the former cases, the high 6 bits, 101101, are applied to the D group. That is, if the two 2 bits are Os, then all elements of the pixel have the same output color data, which is the same value with the high 6 bit of the input color data. FIG. 8*a* shows the output data of the pixel having the 4 elements, when the low 2 bits of the input color data are 0s.

Figure 8B:
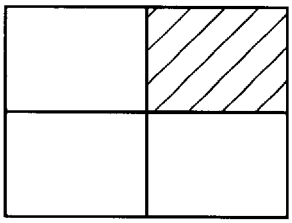

If the input color data is represented as 10110101 in binary, the high 6 bits are 101101 and the low 2 bits are 01. When the Dit1 and Dit2 are 0s, DD is 0 and the A group is selected. Thus, the high 6 bits, 101101, are applied to the A group. When Dit1 is 1 and Dit2 is 0, DD is 1 and the B group is selected. Thus, the one level higher bits than the high 6 bits, 101110, are applied to the B group. When Dit1 is 0 and Dit2 is 1, DD is 0 and the C group is selected. Thus, the high 6 bits, 101101 is applied to the C group. When Dit1 and Dit2 are 1s, DD is 0 and the D group is selected. Thus, the high 6 bits, 101101 is applied to the D group. FIG. 8*b* shows the output data of the pixel having the 4 elements, when the bit0 of the input color data is 1 and bit1 of the input color data is 0.

Figure 8C:
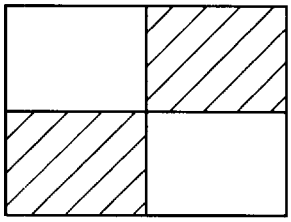

If the input color data is represented as 10110110 in binary digit, the high 6 bits are 101101 and the low 2 bits are 10. When Dit1 and Dit2 are 0s, DD is 0 and the A group is selected. Thus, the high 6 bits, 101101, are applied to the A group. When Dit1 is 1 and Dit2 is 0, DD is 1 and the B group is selected. Thus, the one level higher bits than the high 6 bits, 101110, are applied to the B group. When Dit1 is 0 and Dit2 is 1, DD is 1, and the C group is selected. Thus, the same bits with the B group, 101110, are applied to the C group. When the Dit1 and the Dit2 are 1s, DD is 0 and the D group is selected. So, the high 6 bits, 101101, are applied to the D group. FIG. 8*c* shows the output data of the pixel having the 4 elements, when the bit0 of the input color data is 0 and bit1 of the input color data is 1.

Figure 8D:
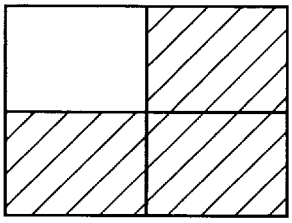

Finally, if the input color data is represented as 10110111 in binary, the high 6 bits are 101101 and the low 2 bits are 11. When Dit1 and Dit2 are 0s, DD is 0 and the A group is selected. Thus, the high 6 bits, 101101, are applied to the A group. When Dit1 is 1 and Dit2 is 0, DD is 1 and the B group is selected. Thus, the one level higher bits than the high 6 bits, 101110, are applied to the B group. When Dit1 is 0 and Dit2 is 1, DD is 1 and the C group is selected. Thus, the one level higher bits, 101110, are applied to the C group. When Dit1 and Dit2 are 1s, DD is 1 and the D group is selected. Thus, the one level higher bits, 101110, are applied to the D group. FIG. 8*d* shows the output data of the pixel having the 4 elements, when the low 2 bits of the input color data are 1s.

Second Embodiment

According to the first embodiment, the elements of the pixel is fixed, thereby allowing the elements to represent fixed color data continuously. Furthermore, as the pixel comprises 4 elements which is designed as pixels, the resolution must be lower. Therefore, the quality of LCD panel should be lower in spite of increasing the representative color number.

Figure 9A:
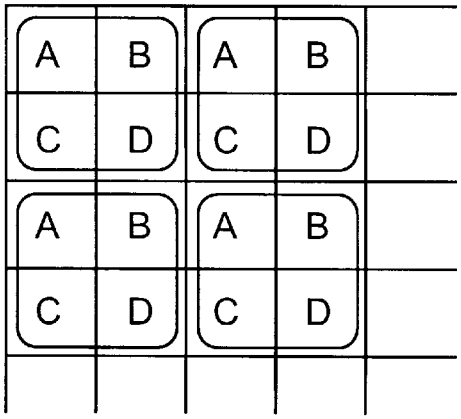
FIGS. 9*a* and 9*b* are alternated dither color patterns which are shifted by a frame according to a second embodiment of the present invention.
Figure 9B:
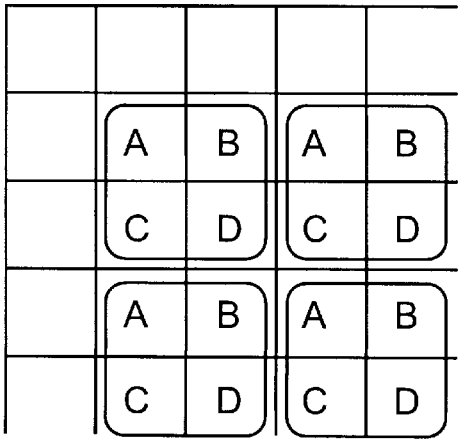
Figure 10:
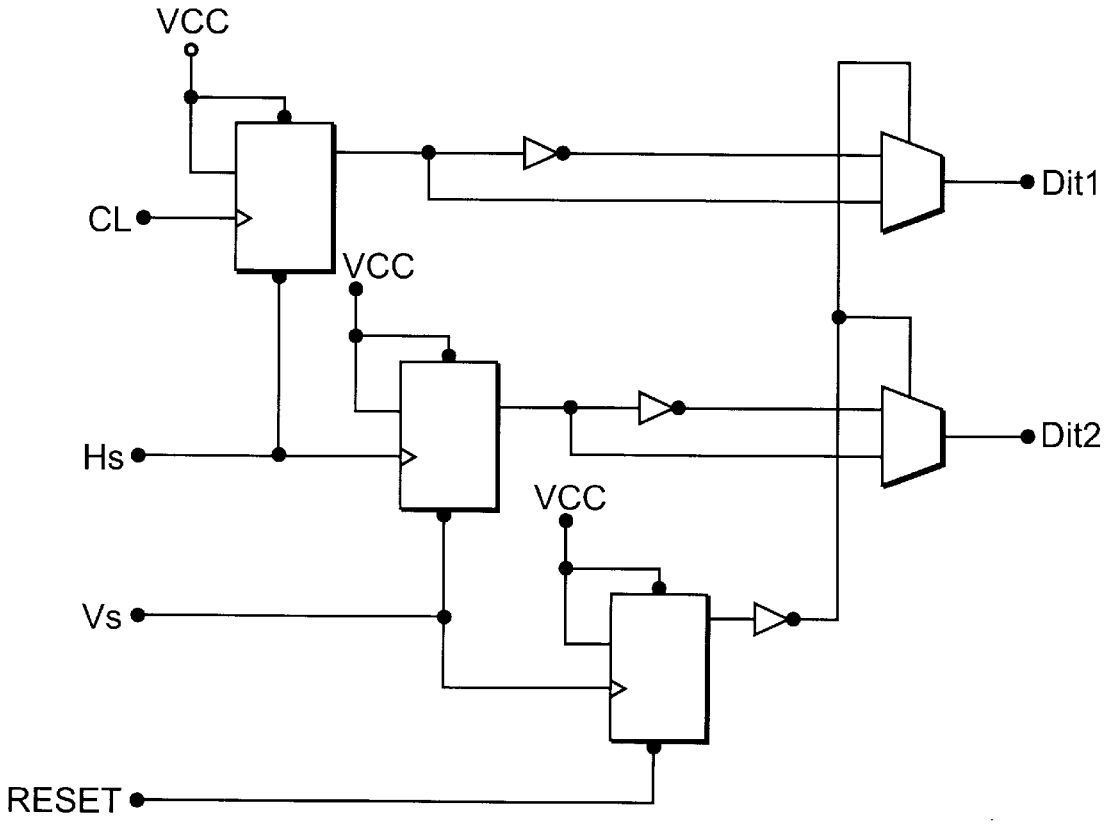
FIG. 10 is a schematic diagram of the dither timing generator according to the second embodiment of the present invention.

In order to increase the image quality, the pixels are grouped alternatively at each frame. For example, at the first frame, the pixels are grouped as mentioned in the first embodiment, and at the next frame, the pixels are grouped by shifting in accordance to the one horizontal and one vertical line, and at the next frame, the pixels are grouped as the first style, as shown FIG. 9. In order to realize the alternative grouping, the dither timing generator can comprises circuits as shown FIG. 10.

FIG. 11 shows a portion of the LCD panel according to the first embodiment, and the FIGS. 12*a* and 12*b* show the LCD panel according to the second embodiment. At the pixel elements, the distinguished color data comprising 6 bits are applied. However, the one pixel reproduced the true color by combining the 4 elements colors. The pixel having 6 bits color level can reproduce true color having 8 bits color level.

In the color LCD, if the color level is 8 bits, then the signal bus lines for red (R) color, green (G) color and blue (B) color are each eight lines. So, the total signal lines are 24 lines. Then, the manufacturing method for comprising the signal bus lines is very complicated and the driver IC for signal bus line is very expensive.

However, the present invention generates 6 bit color level using 8 bit color level and reproduces the real color using the pseudo real color. Accordingly, the signal bus lines are 6 lines at each color element (R, G and B), the total bus lines are 18 lines. Finally, the manufacturing method for the color LCD is simplified. The cost for the color LCD is lower than conventional method, as using 6 bit driver IC. Furthermore, the present invention does not comprise the ROM table in reproducing the color, thereby reducing the cost for the color LCD.

It will be apparent to those skilled in the art that various modifications and variations can be made in the multicolor display control method for liquid crystal display of the present invention without departing from the spirit or scope of the invention. Thus it is intended that the present invention cover the modifications and variations of this invention provided they come within the scope of the appended claims and their equivalents.

What is claimed is:

1. A dither circuit for reproducing a multicolor image, comprising:

a latch having input terminals for 8 input data bits and a clock signal, and output terminals for six high bits and two low bits of the input data bits;

a dither timing generator having input terminals for a horizontal sync signal, a vertical sync signal and a clock signal and output terminals for a first dither timing bit and a second dither timing bit, wherein the first dither timing bit is toggled according to each cycle of the horizontal sync signal and the second dither timing bit is toggled according to each cycle of the vertical sync signal;

a dither data controller having input terminals for the two low bits, the first and the second dither timing bits and an output terminal for applying four dither data bits generated using the two low bits and the first and the second dither timing bits sequentially; and an adder having an input terminal for the four dither data bits and the six high bits, and the output terminals for six output data bits.

2. The dither circuit according to claim 1, wherein the input terminals for the 8 input data bits are applied 8 bits of color data of video signals.

3. The dither circuit according to claim 1, wherein the dither timing generator includes:

a first dither timing generator for producing a first dither signal having a period twice that of the clock signal; and a second dither timing generator producing a second dither signal having a period twice that of twice the horizontal sync signal; and a frame timing generator producing a frame timing signal having a period twice that of the vertical sync signal.

4. The dither circuit according to claim 3, wherein the dither timing generator further includes:

a first multiplexor for processing the frame timing signal, the first dither signal and a reversed signal of the first dither signal; and a second multiplexor for processing the frame timing signal, the second dither signal and a reversed signal of the second dither signal.

5. The dither circuit according to claim 1, wherein the dither data controller includes:

a first AND circuit for producing a first value using the first dither timing bit, a reversed bit of the second dither timing bit and a most lower bit of the two low bits;

a second AND circuit for producing a second value using the first dither timing bit, a reversed bit of the second dither timing bit and a least lower bit of the two low bits;

a third AND circuit for producing a third value using the second dither timing bit and the two low bits;

a fourth AND circuit for producing a fourth value using a reversed bit of the first dither timing bit, the second dither timing bit and the least lower bit of the two low bits; and an OR circuit for producing the dither data bit using the first, the second, the third and the fourth values.

6. The dither circuit according to claim 1, wherein the four dither data bits are 0s, when the two low bits are 0s.

7. The dither circuit according to claim 1, wherein one of the four dither data bits is 1 and the other dither data bits are 0s, when only the lowest bit is 1.

8. The dither circuit according to claim 1, wherein two of the four dither data bits are 1s and the other dither data bits are 0s, when only the mist lower bit is 0.

9. The dither circuit according to claim 1, wherein three of the four dither data bits are 1s and one of the dither data bit is 0 when the two low bits are 1s.

10. The dither circuit according to claim 1, wherein the adder further includes a detector for detecting the high six bits all being 1s.

11. The dither circuit according to claim 1, wherein the latch further includes a detector for detecting the high six bits all being 1s.

12. A dither circuit for reproducing a multicolor image, comprising:

a latch having input terminals for L input data bits and a clock signal, and output terminals for high L-2 bits and two low bits of the input data bits;

a dither timing generator having input terminals for a horizontal sync signal, a vertical sync signal and a clock signal and output terminals for a first dither timing bit and the second dither timing bit, wherein the first dither timing bit is toggled according to each cycle of the horizontal sync signal and the second dither timing bit is toggled according to each cycle of the vertical sync signal;

a dither data controller having input terminals for the two low bits, the first and the second dither timing bits, and an output terminal for applying four dither data bits generated using the two low bits and the first and the second dither timing bits sequentially; and an adder having an input terminal for the four dither data bits and the high L-2 bits, and output terminals for L-2 output data bits.

13. The dither circuit according to claim 12, wherein the input terminals for the L input data bits are applied L bits of color data of video signals.

14. The dither circuit according to claim 12, wherein the dither timing generator includes:

a first dither timing generator for producing a first dither signal having a period twice that of the clock signal; and a second dither timing generator producing a second dither signal having a period twice that of twice the horizontal sync signal; and a frame timing generator producing a frame timing signal having a period twice that of the vertical sync signal.

15. The dither circuit according to claim 14, wherein the dither timing generator further includes:

a first multiplexor for processing the frame timing signal, the first dither signal and a reversed signal of the first dither signal; and a second multiplexor for processing the frame timing signal, the second dither signal and a reversed signal of the second dither signal.

16. The dither circuit according to claim 12, wherein the dither data controller includes:

a first AND circuit for producing a first value using the first dither timing bit, a reversed bit of the second dither timing bit and a most lower bit of the two low bits;

a second AND circuit for producing a second value using the first dither timing bit, a reversed bit of the second dither timing bit and a least lower bit of the two low bits;

a third AND circuit for producing a third value using the second dither timing bit and the two low bits;

a fourth AND circuit for producing a fourth value using a reversed bit of the first dither timing bit, the second dither timing bit and the least lower bit of the two low bits; and an OR circuit for producing the dither data bit using the first, the second, the third and the fourth values.

17. The dither circuit according to claim 12, wherein the four dither data bits are 0s, when the two low bits are 0s.

18. The dither circuit according to claim 12, wherein one of the four dither data bits is 1 and the other dither data bits are 0s, when only the lowest bit is 1.

19. The dither circuit according to claim 12, wherein two of the four dither data bits are 1s and the other dither data bits are 0s, when only the lowest bit is 0.

20. The dither circuit according to claim 12, wherein three of the four dither data bits are 1s and one of the dither data bits is 0 when the low 2 bits are 1s.

21. The dither circuit according to claim 12, wherein the adder further includes a detector for detecting the high L-2 bits all being 1s.

22. The dither circuit according to claim 12, wherein the latch further includes a detector for detecting the high L-2 bits all being 1s.

23. A method for reproducing a dithered multicolor image on a display screen, comprising the steps of:

receiving multicolor data having L bits corresponding to a portion of the display screen including first, second, third, and fourth pixels, wherein the L bits have L-2 high bits and 2 low bits, wherein the L-2 high bits have a value of M, and wherein the 2 low bits are one of first, second, third and fourth states; and applying L-2 high bits to each one of the first, second, third, and fourth pixels, wherein M is applied to the first, second, third, and fourth pixels when the 2 low bits define the first state, wherein the M is applied to the first, second, and third pixels and M+1 is applied to the fourth pixel when the 2 low bits define the second state, wherein M is applied to the first and second pixels and M+1 is applied to the third and fourth pixels when the 2 low bits define the third state, and wherein M is applied to the first pixel and M+1 is applied to the second, third, and fourth pixels when the 2 low bits define the fourth state.

24. The method according to claim 23, wherein the first, second, third, and fourth pixels are arranged in a 2×2 matrix.

25. The method according to claim 23, wherein the step of applying the L-2 high bits includes the step of outputting the L-2 high bits to corresponding signal bus lines.

* * * * *